US005732925A

United States Patent [19]

Shamoon

[11] Patent Number: 5,732,925

[45] Date of Patent: Mar. 31, 1998

[54] CLIPBOARD WITH ART SUPPLY CONTAINER

[76] Inventor: Ellis N. Shamoon, 2833 Park Bridge Ct., Dallas, Tex. 75219

[21] Appl. No.: 437,849

[22] Filed: May 9, 1995

Related U.S. Application Data

[63] Continuation-in-part of Ser. No. 34,732, Feb. 10, 1995, Pat. No. Des. 366,501.

[51] Int. Cl.[6] ..... A47B 97/04

[52] U.S. Cl. ..... 248/452; 248/450

[58] Field of Search ..... 248/452, 451, 248/450, 441.1; 24/67.1, 67.11; 211/45, 50; 108/44; 281/45, 42, 51; D19/65, 88

[56] References Cited

U.S. PATENT DOCUMENTS

| | | | |
|---|---|---|---|
| D. 354,772 | 1/1995 | Flickinger | D19/88 |
| D. 366,501 | 1/1996 | Shamoon | D19/88 |
| 2,170,709 | 8/1939 | Cutrow | 41/4 |
| 2,741,048 | 4/1956 | Shelton | 41/5 |
| 3,188,036 | 6/1965 | Sprung | 248/205 |
| 3,346,098 | 10/1967 | Sherbinin | 206/1.7 |
| 3,389,945 | 6/1968 | Thomas | 312/231 |
| 3,620,362 | 11/1971 | Valdez | 248/441 |
| 5,116,012 | 5/1992 | Offenhauer | 248/452 |
| 5,180,133 | 1/1993 | Chang | 248/452 |
| 5,413,382 | 5/1995 | Cornell | 281/45 |

*Primary Examiner*—Leslie A. Braun
*Assistant Examiner*—Gwendolyn W. Baxter
*Attorney, Agent, or Firm*—Daniel V. Thompson

[57] ABSTRACT

A combination of a clipboard and art supply container is provided. The clipboard includes a board and a clip attached to the board. The clip is specially constructed and adapted to removably hold the art supply container. Multiple art supply containers may be furnished containing different art supply media.

8 Claims, 3 Drawing Sheets

CLIPBOARD WITH ART SUPPLY CONTAINER

CROSS REFERENCE TO RELATED APPLICATION

This application is a continuation in part of application Ser. No. 34,732, filed Feb. 10, 1995, now U.S Design Pat. No. 366,501.

TECHNICAL FIELD

This invention relates to clipboards, and more particularly to the combination of a clipboard and a removably attached art supply container.

BACKGROUND ART

Clipboards have long been known in the art as convenient tools to hold writing or drawing materials. It is not known, however, to attach an art supply container to a clipboard, or to provide apparatus with the clipboard for removably attaching multiple art supply containers containing different art media, such as watercolors, crayons or chalk.

SUMMARY OF THE INVENTION

The present invention provides the combination of a clipboard and an art supply container. The clipboard includes a board and a clip attached to the board. The clip is specially constructed and adapted to removably hold the art supply container. Multiple art supply containers, identically constructed, but containing different types of art supply media, may be provided.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 1:
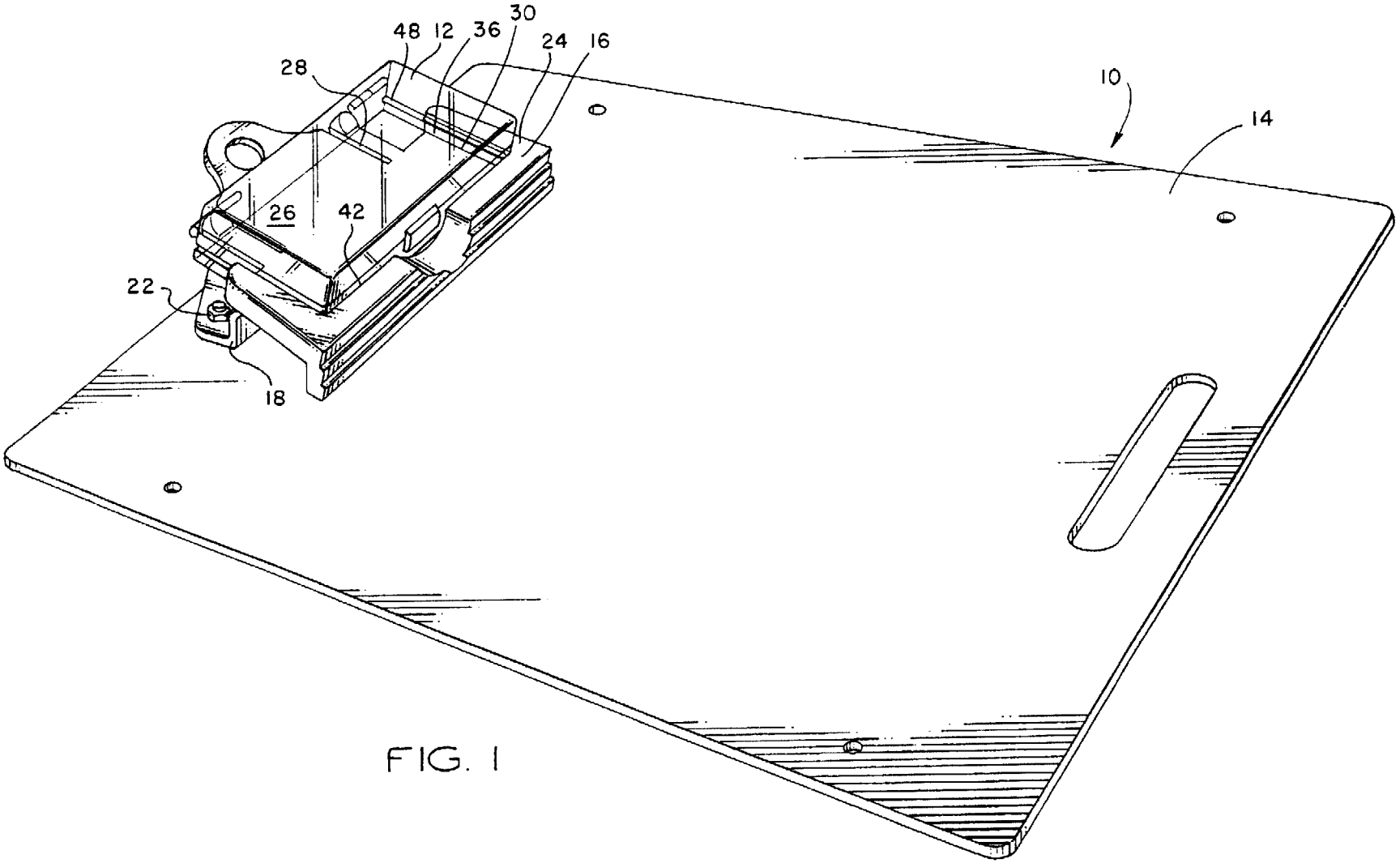
FIG. 1 is a perspective view of the combination clipboard and art supply container of the present invention.
Figure 2:
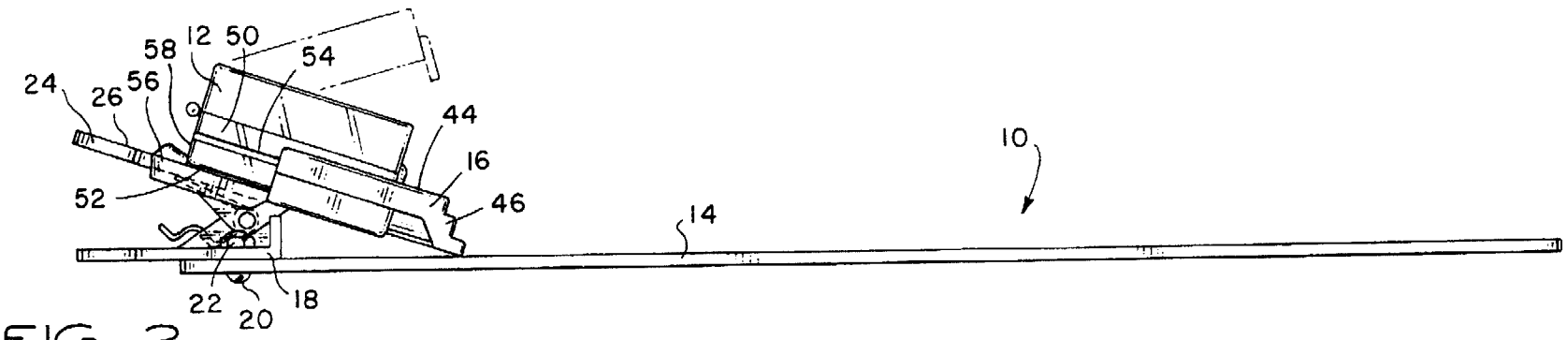
FIG. 2 is a side view of the apparatus of FIG. 1.
Figure 3:
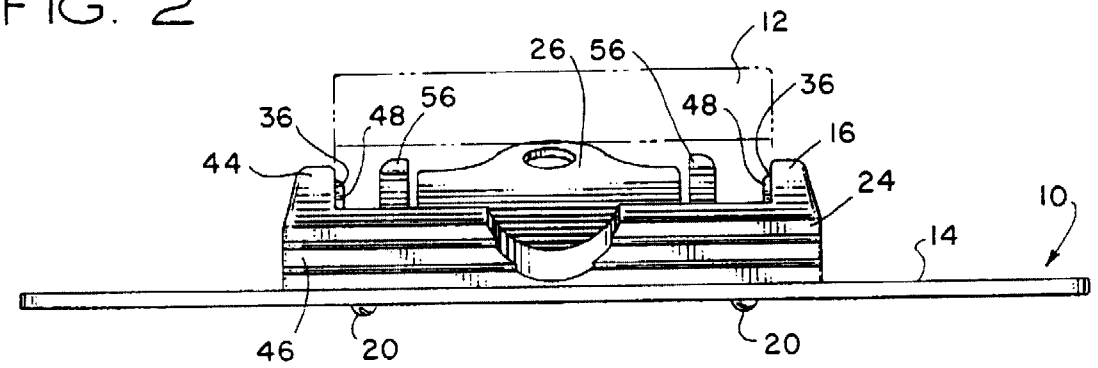
FIG. 3 is a bottom view of the apparatus.
Figure 4:
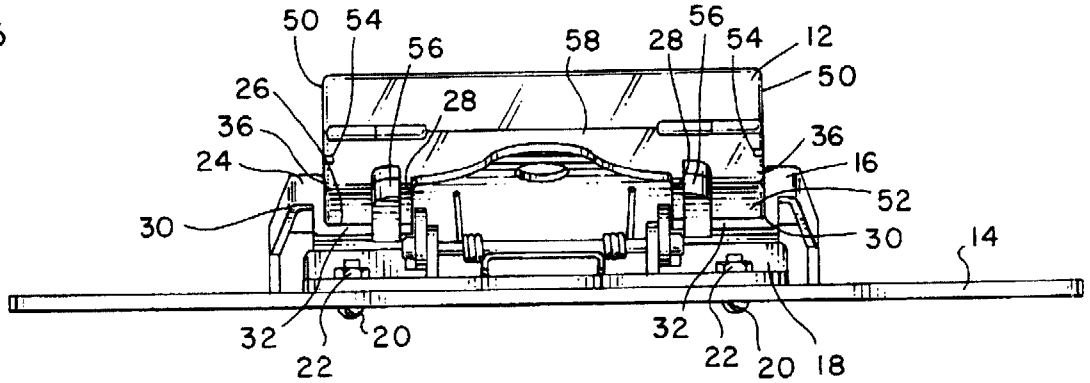
FIG. 4 is a top view of the apparatus.
Figure 5:
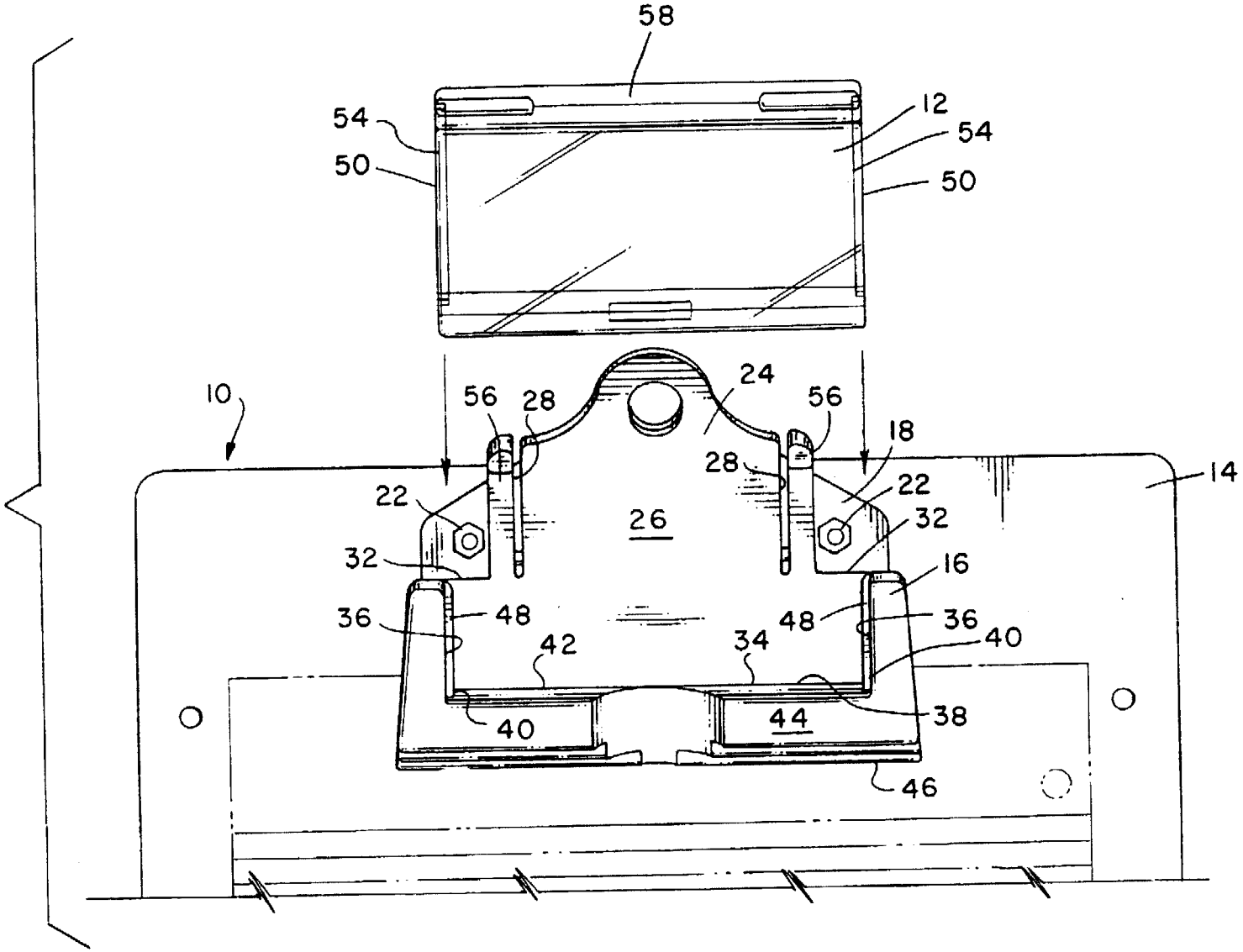
FIG. 5 is a partial view illustrating use of the apparatus.

Referring to FIGS. 1–5, where like numerals refer to like and corresponding elements, a clipboard 10 is combined with an art supply container 12. Clipboard 10 includes a board 14 and a clip 16. Clip 16 is constructed and adapted to removably hold the art supply container 12.

Clip 16 has a back 18 connected to board 14 by way of bolts 20 and nuts 22. Pivot member 24 is pivotally connected to the back 18.

Pivot member 24 has a flat, planar, bottom surface 26 with upper and lower side edges 28, 30, intermediate edges 32, and a bottom edge 34. The upper side edges 28 are parallel and inset from the lower side edges 30. The upper side edges 28 are joined to the lower side edges 30 by the intermediate edges 32. The intermediate edges 32 are perpendicular to the upper and lower side edges 28, 30. The bottom edge 34 is parallel to the intermediate edges 32.

Pivot member 24 has sidewalls 36 extending perpendicularly from the lower side edges 30 of the bottom surface 26.

Pivot member 24 also has a bottom wall 38 extending perpendicularly from the bottom edge 34. Sidewalls 36 and bottom wall 38 are joined at opposite corners 40 to form a three-sided pocket 42 with the pivot member bottom surface 26.

Pivot member 24 has a top surface 44 parallel to the bottom surface 26 and extending outwardly from the sidewalls 36 and bottom wall 38. Pivot member 24 has a contact element 46 extending downwardly from the top surface 44 to contact the board 14.

Art supply container 12 is removably held by clip 16 by way of the pivot member sidewalls 36 having inwardly-extending ribs 48 parallel to the bottom wall 26. The art supply container 12 has sidewalls 50 and a bottom wall 52. The sidewalls 50 have grooves 54 corresponding to the pivot member sidewall ribs 48. The container bottom wall 52 contacts the pivot member bottom wall 26, such that the container 12 is slidably engaged with the clip 16.

In the preferred embodiment, retainer fingers 56 extend from the intermediate edges 32 of the pivot member 24 to engage the back wall 58 of the art supply container 12. Retainer fingers 56 are bendable to release the container 12 from the clip 16, if desired.

In operation, the invention provides a portable drawing board with a clip to hold for example, a drawing pad tight no matter where it is being used. Art supply containers 12 may be provided in multiple, containing crayons, watercolors, color pens, chalk or the like. The invention is particularly suitable for children to use while traveling, because everything to draw with is at the user's fingertips yet easily and conveniently used. Change outs in media, such as from crayons to watercolors, are easily accomplished without making a mess.

Whereas, the present invention has been described with respect to a specific embodiment thereof, it will be understood that various changes and modifications will be suggested to one skilled in the art and it is intended to encompass such changes and modifications as fall within the scope of the appended claims.

I claim:

1. The combination of a clipboard and an art supply container, comprising:

a board, and a clip attached to the board;

the clip removably holding the art supply container;

with the clip having a back connected to the board;

the clip having a pivot member pivotally connected to the back; and with the pivot member having surfaces, edges and walls defining a pocket securing the art supply container thereto, whereby said art supply container is adapted to be slidably received within the pivot member pocket.

2. The combination of claim 1 with the pivot member having a flat, planar, bottom surface with side edges and a bottom edge; and the pivot member having sidewalls extending from the side edges of the bottom surface;

the pivot member having a bottom wall extending from the bottom edge;

the sidewalls and bottom wall being joined at opposite corners to form a three-sided pocket with the pivot member bottom surface.

3. The combination of claim 2 with the pivot member having a top surface parallel to the bottom surface and extending outwardly from the sidewalls and bottom wall; and the pivot member having a contact element extending downwardly from the top surface to contact the board.

4. The combination of claim 1 with the pivot member having a flat, planar, bottom surface with upper and lower side edges, intermediate edges, and a bottom edge; and the upper side edges being parallel to and inset from the lower side edges, the upper side edges being joined to the lower side edges by the intermediate edges, the intermediate edges being perpendicular to the upper and lower side edges, and the bottom edge being parallel to the intermediate edges;

the pivot member having sidewalls extending perpendicularly from the lower side edges of the bottom surface;

the pivot member having a bottom wall extending perpendicularly from the bottom edge;

the sidewalls and bottom wall being joined at opposite corners to form a three-sided pocket with the pivot member bottom surface.

5. The combination of claim 4 with the pivot member having a top surface parallel to the bottom surface and extending outwardly from the sidewalls and bottom wall; and the pivot member having a contact element extending downwardly from the top surface to contact the board.

6. A combination of a clipboard and an art supply container, comprising:

a board, and a clip attached to the board;

the clip being constructed and adapted to removably hold the art supply container;

with the clip having a back connected to the board;

the clip having a pivot member pivotally connected to the back;

with the pivot member having surfaces, edges and walls defining a pocket for the art supply container;

with the pivot member having sidewalls and a bottom wall;

the sidewalls having inwardly-extending ribs parallel to the bottom wall; and the art supply container having sidewalls and a bottom wall, the sidewalls having grooves corresponding to the pivot member sidewall ribs, and the container bottom wall contacting the pivot member bottom wall, such that the container is slidably engaged with the clip.

7. A combination of a clipboard and an art supply container, comprising:

a board, and a clip attached to the board;

the clip being constructed and adapted to removably hold the art supply container;

with the clip having a back connected to the board;

the clip having a pivot member pivotally connected to the back;

with the pivot member having surfaces, edges and walls defining a pocket for the art supply container;

with retainer fingers extending from the edges of the pivot member to engage a back wall of the art supply container, the retainer fingers being bendable to release the container from the clip.

8. The combination of a clipboard and an art supply container, comprising:

a board and clip attached to the board;

the clip being constructed and adapted to removably hold an art supply container;

the clip having a back connected to the board;

the clip having a pivot member pivotally connected to the back;

the pivot member having a flat, planar, bottom surface with upper and lower side edges, intermediate edges, and a bottom edge;

the upper side edges being parallel to and inset from the lower side edges, the upper side edges being joined to the lower side edges by the intermediate edges, the immediate edges being perpendicular to the upper and lower side edges, and the bottom edge being parallel to the intermediate edges;

the pivot member having sidewalls extending perpendicularly from the lower side edges of the bottom surface;

the pivot member having a bottom wall extending perpendicularly from the bottom edge;

the sidewalls and bottom wall being joined at opposite corners to form a three-sided pocket with the pivot member bottom surface;

the pivot member having a top surface parallel to the bottom surface and extending outwardly from the sidewalls and bottom wall;

the pivot member having a contact element extending downwardly from the top surface to contact the board;

the pivot member sidewalls having inwardly-extending ribs parallel to the bottom wall;

the art supply container having sidewalls and a bottom wall, the sidewalls having grooves corresponding to the pivot member sidewall ribs, and the container bottom wall contacting the pivot member bottom wall, such that the container is slidably engaged with the clip; and retainer fingers extending from the intermediate edges of the pivot member to engage a back wall of the art supply container, the retainer fingers being bendable to release the container from the clip.

* * * * *